US005266198A

United States Patent [19]

Vikiö

[11] Patent Number: 5,266,198

[45] Date of Patent: Nov. 30, 1993

[54] HYDROCYCLONE WITH A SHELL MEAN DETERMINING TUBE EMBEDDED IN THE SHELL

[75] Inventor: Pentti Vikiö, Kerimäki, Finland

[73] Assignee: A. Ahlstrom Corporation, Noormarkku, Finland

[21] Appl. No.: 957,944

[22] Filed: Oct. 8, 1992

[30] Foreign Application Priority Data

Oct. 17, 1991 [CA] Canada ..... 2,053,651

[51] Int. Cl.[5] ..... B04C 5/08

[52] U.S. Cl. ..... 210/512.1; 209/211; 73/49.1

[58] Field of Search ..... 210/512.1; 209/144, 209/211; 55/459.1; 73/49.1, 49.2, 49.3

[56] References Cited

U.S. PATENT DOCUMENTS 2,953,248 9/1960 Troland ..... 210/512.1
3,902,601 9/1975 Townley ..... 210/512.1
4,211,643 7/1980 Frykhult et al. ..... 209/211
4,278,534 7/1981 Jakobson ..... 210/512.1
4,358,369 11/1982 Matula et al. ..... 209/211
5,024,755 6/1991 Livsey ..... 209/211

FOREIGN PATENT DOCUMENTS 2021005A 11/1979 United Kingdom .
1593333 7/1981 United Kingdom .

*Primary Examiner*—Robert A. Dawson
*Assistant Examiner*—David Reifsnyder
*Attorney, Agent, or Firm*—Nixon & Vanderhye

[57] ABSTRACT

A hydrocyclone is provided with a wear monitoring element of the type of a tube (24) or the like embedded in the wall section of the shell of the hydrocyclone. When the furrows worn by abrasive fraction of the cyclone are deep enough to reach the monitoring element, the wear causes a visually observed leak or some other signal alerting the operating personnel to the need of replacing the partly worn hydrocyclone.

13 Claims, 1 Drawing Sheet

HYDROCYCLONE WITH A SHELL MEAN DETERMINING TUBE EMBEDDED IN THE SHELL

The present invention relates to a hydrocyclone for classifying or separating a stock into a first fraction and a second fraction one of the two fractions usually being a so-called accept fraction and the other a so-called reject fraction.

Hydrocyclones are commonly used in many branches of industry and in particular in cellulose and paper mills to purify fibre suspensions from dirt materials such as sand, bark and pieces of branches and metal particles. The fibre suspension to be purified is passed under pressure into the hydrocyclone, in the converging sorter cone of which it is forced into a vortex motion causing centrifugal forces by means of which the component materials of the fibre suspension having different specific gravities are separated from each other. As the fibre suspension vortex progresses towards the apex of the sorter cone, the materials having a higher specific gravity, such as sand, are flung out on the walls of the sorting cone, and the sand particles move on helical paths following these walls towards the relatively small diameter rejects discharge nozzle at the apex of the sorter cone. In the vicinity of the nozzle, where the sand particles revolve in a nearly circular orbit, that is in a nearly unchanged plane at right angles to the axis of the cone, and where the velocity of the rotary motion is high, furrows are known to be worn in the walls of the sorter cone as a consequence of the friction encountered, particularly so in hydrocyclones made of wear resistant synthetic material, such as polyamide or polyurethane. In some instances the furrows have become so deep as to cause the narrow end portion of the sorter cone to be completely cut off. The consequence is then that the fibre suspension in the hydrocyclone is discharged into the ambient space.

Since, for instance, a hydrocyclone battery or installation upstream of a paper making machine may comprise a great number of separate cyclones, all of which must continuously operate perfectly in the purification of the fibre suspension that is conducted to the paper machine, an unexpected breakage of any one hydrocyclone may cause even a shut-down of the paper making machine, entailing production losses. Moreover, the sudden discharge into ambient space of fibre suspension stock may cause failure in the other equipment and dirty places and in worst case, when hot, stock may cause accidents to personnel.

Attempts have been made to eliminate the drawbacks mentioned, by providing the hydrocyclone with an outer jacket surrounding the sorter cone. An enclosed space is thus provided between the sorter cone and the outer jacket. The mixture of materials in the hydrocyclone may discharge into the space when the sorter cone is worn through. A sensing element is provided which indicates that a leak from the cyclone into the space has occurred. Thus, leakage from a severed sorter cone into ambient space can be prevented. If the outer jacket is made of a transparent material, it is furthermore possible to observe visually the leak into the intermediate space.

The centrifugal force acting on the impurity particles is constant in each plane perpendicular to the axis of the sorter cone. This is due to the fact that the peripheral velocity and orbit radius are constant. Consequently, the depth of the furrow worn into the inside surface of the shell or wall section is constant over the entire circumference of the shell. This, in turn has the consequence that the sorter cone will eventually be entirely cut off, and a large quantity if fibre suspension will discharge into the interspace. This defect has a detrimental effect of the purifying capacity of hydrocyclones of the same battery of cyclones, since the pressure conditions are suddenly changed in the group. Furthermore, the hydrocyclone with an outer jacket is expensive to manufacture.

It is also know to provide the shell of the sorter cone with at least one recessed line or narrow groove extending over a part or all of its length, whereby the thickness of the wall is substantially reduced at the groove. As the wear proceeds, a perforation eventually occurs in the recessed line, the resulting leakage being recoverable in a closed chamber located on the outside of the hydrocyclone which chamber is formed by affixing to the margins of the recessed line a fluted strip with closed ends. While this is a clear improvement over the first mentioned hydrocyclone, there still remain some problems. When manufacturing the cyclone the recessed line may be produced simultaneously with the shell in a suitably shaped mould. However, the fluted strip is a separate component to be manufactured separately, and a still another step of manufacture is required to affix the strip to the margins of the recessed line.

It is an object of the present invention to further advance the art of hydrocyclones by providing improved means for monitoring the wear in the wall of a hydrocyclone. In general terms, the present invention provides a hydrocyclone for classifying a stock to a first fraction and a second fraction, comprising, in combination:a) a shell defining an elongated chamber having a generally circular cross-section; b) a generally tangential inlet into said shell for the stock to be classified; c) a first axial outlet at one end of said shell, for said first fraction; d) a second axial outlet at the other end of said shell, for said second fraction; e) at least a portion of said elongated chamber being determined by a conical wall section converging axially towards said first outlet and diverging axially towards said second outlet; and f) an arrangement for determining the degree of wear of said shell; g) said arrangement including a wear sensing portion secured to said shell and extending along at least a part of axial length of said hydrocyclone.

Preferably, the wear sensing portion is a cylindric cavity, for instance a tube made from a non-wear resistant material such as aluminum, which is embedded in the wall of the shell. The cavity communicates with the exterior of the hydrocyclone to indicate the leak before a complete separation of the cone is likely to occur.

The present invention will be described by way of an exemplary embodiment, with reference to the accompanying simplified, diagrammatic drawings. In the drawings.

Figure 1:
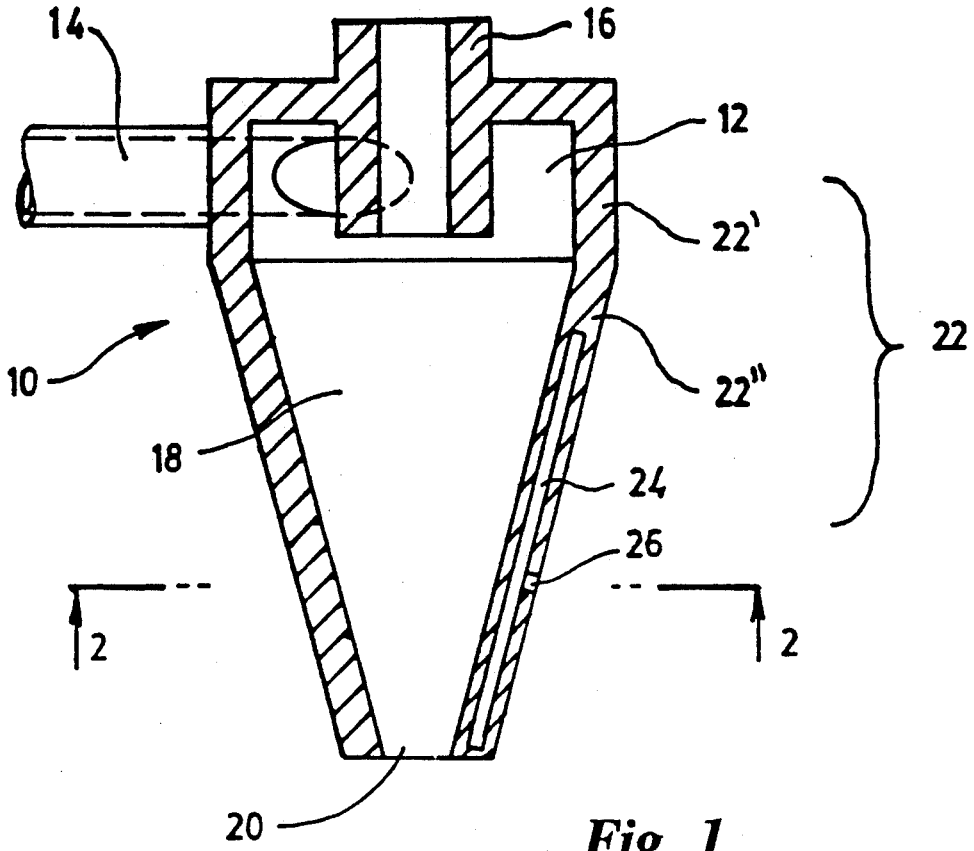
FIG. 1 is a longitudinal section of a hydrocyclone according to one embodiment of the present invention.
Figure 2:
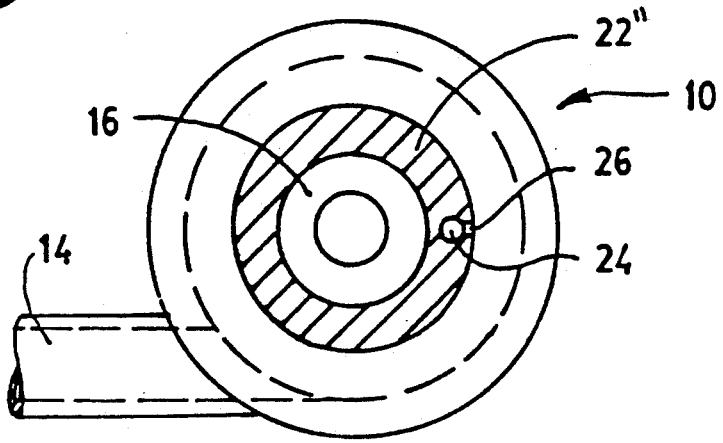
FIG. 2 is cross section A-A of FIG. 1.

As shown in FIGS. 1 and 2, the hydrocyclone 10 has a shell 22 which defines a separating chamber having the shape of an elongated cavity of a generally circular cross-section. The shell includes a normally upper cylindrical part 12 provided with a tangential inlet 14 through which the stock to be classified is introduced under pressure into the hydrocyclone. A coaxial outlet reaching into the cylindrical part 12 is affixed to the top cover of the hydrocyclone. It removes accept fraction separated from the incoming stock mixture. In general terms, it is one of two axial outlets of the hydrocyclone.

The lower end of the cylindrical part 12 is provided with an extension having the shape of a sorter cone 18. The cone 18 has at its apex a reject nozzle 20 for removing reject fraction separated from the mixture during vortex motion within the hydrocyclone. The reject nozzle thus forms the other "axial outlet" as referred to hereafter.

The structural elements thus far described are well known. It is also known that the structure shown is only one alternative of a number of different variations. For instance the cylindrical part of the hydrocyclone may well be entirely omitted and the conical portion may extend into the cover of the hydrocyclone.

The structure of hydrocyclones is well known in the art and does not in itself have to be described in greater detail.

Figure 3:
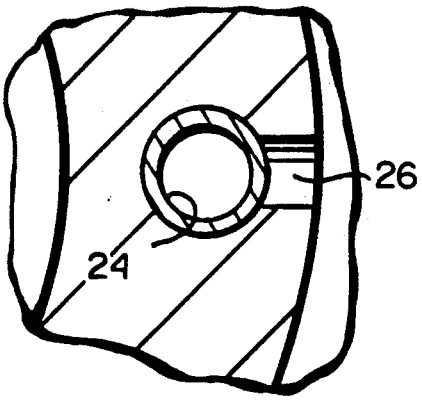
FIG. 3 is an enlargement of a portion of the hydrocyclone of FIG. 2 illustrating the tube therein.

Turning back to FIGS. 1 through 3, the shell 22 is formed of a cylindrical wall section 22' and the cone 18 forms a conical wall section 22''. The conical wall section 22'' is provided with an elongated conduit. The conduit presents one embodiment of what is generally referred to as a "wear sensing portion".

In the embodiment shown, the conduit is a tube 24 made of a wear-non-resistant material, in particular aluminum. It extends over at least a part, and preferably over a substantial portion of the axial length of the conical wall 22''. Both ends of the tube member are closed. Thus, the interior of the tube remains hollow during the moulding of the plastics wall of cyclone 10. As shown in the drawings, the tube 24 may be secured to the shell by making it entirely surrounded by the thickness of the wall section of the cyclone. The preferred material of the wall section is polyurethane.

The tube 24 may also be positioned against the wall of the mould for making the shell such that the outermost surface portion of the tube 24 is flush with the outer surface of the conical wall section of the cyclone. It is, of course, also conceivable to mould the cavity directly in the wall of the cyclone, even though this might require special plastics moulding techniques.

When the tube 24 is entirely embedded in the hydrocyclone material it may be fixed, at the manufacturing stage, to the mould by means of a bolt or pin, which leaves a hole 26 in the conical wall 22'' as well as a hole in the wall of the tube 24.

In operation the solid particles whirl along the inner surface of the wall 22'', and eventually wear the wall until they reach the tube surface. They very quickly wear a hole in the tube so that the liquid from the cyclone can enter the tube 24. When the tube fills with liquid, a very small amount of the liquid starts flowing through the hole 26. When the flow through the hole 24 is detected, the hole is tapped and the cyclone thus marked for replacement during the next maintenance stop of the associated paper making machine or the like equipment.

The aluminum material may be replaced with a suitable synthetic material. It is preferred that the material be not very wear resistant. Its resistance should be equal or less than that from which the wall sections of the cyclone are made. This ensures that the wear of the wall produces a perforation in the tube wall soon so that the leak through the hole 26 can be monitored in good time prior to the actual need of replacement.

Naturally, there are other possibilities to detect the leakage into the tube other than visual checkup. For instance, the tube may be provided with an electronic sensor producing an alarm impulse when some liquid has leaked in the tube.

An alternative embodiment to detect the degree of wear of the shell wall might be to arrange a conductor wire in the wall material at an appropriate depth and connect such by means of wires to a signal device, which might be a lamp or some other suitable device. Yet another way to detect the degree of wear in a cyclone shell might be to provide the wall of the shell with a pair of conductor stripes having a small gap therebetween and to connect such by means of a wires to a signal device. After the particles revolving along the inner wall of the shell have worn the wall to the depth of the conductor stripes the liquid acts as a conductor and closes the circuit. These different kinds of electrical arrangements for signalling the wear may not, however, be reasonable and practical, as the number of cyclones in a cleaning unit usually exceeds one hundred and the wiring needed to connect the cyclones to a control room or a control table becomes complicated and even expensive. It is also to be taken into account that as the number of electrical connections is that high there exists always a big risk of a connection failure or breakage, whereby the risk of unexpected leakage and breakage of a cyclone is very high.

As described above there are different ways and alternate arrangement to detect the wear of a hydrocyclone. A common feature to all those embodiments of the present invention is that the device signalling the wear is secured to the wall section of the hydrocyclone shell during the manufacturing stage in the hydrocyclone wall. In other words, now that most of the hydrocyclones are made by means of moulding a synthetic material in a mould, the signalling device is arranged in the mould before the introduction of the synthetic material for casting or moulding. As a result, the cyclone does not require additional manufacturing steps after the moulding.

Though some alternatives have been explained above, there are still a number of other variations of the invention, which may differ from the embodiments described but which fall within the scope of the invention. Accordingly, we wish to protect by letters patent which may issue on this application all such embodiments as fairly fall within the scope of our contribution to the art.

We claim:

1. A hydrocyclone for classifying a stock to a first fraction and a second fraction, comprising in combination;

a) an integral, unitary shell defining an elongated chamber having a generally circular cross-section;

b) a generally tangential inlet into said shell for the stock to be classified;

c) a first axial outlet at one end of said shell, for said first fraction;

d) a second axial outlet at the other end of said shell, for said second fraction;

e) at least a portion of said elongated chamber being determined by a conical wall section of said shell converging axially towards said first outlet and diverging axially towards said second outlet; and f) means for determining the wear of said shell, said means comprising an elongated tube embedded in said conical wall section of said shell, until wear occurs surrounded on all sides by said conical wall section of said shell.

2. The hydrocyclone as recited in claim 1 further comprising an opening providing communication between the conduit and an area exterior of said shell conical wall section.

3. A hydrocyclone as recited in claim 2 wherein said tube is made of a material having wear-resistant properties the same as, or less than, the material of said conical wall section of said shell.

4. A hydrocyclone as recited in claim 2 wherein said elongated tube is made of aluminum.

5. A hydrocyclone as recited in claim 2 wherein both said shell, including said conical wall section thereof, and said tube are made of plastic.

6. A hydrocyclone as recited in claim 2 wherein said elongated tube extends the majority of the length of said conical wall section between said first and second outlets.

7. A hydrocyclone as recited in claim 1 wherein said tube is made of a material having wear-resistant properties the same as, or less than, the material of said conical wall section of said shell.

8. A hydrocyclone as recited in claim 7 wherein said elongated tube is made of aluminum.

9. A hydrocyclone as recited in claim 7 wherein both said shell, including said conical wall section thereof, and said tube are made of plastic.

10. A hydrocyclone as recited in claim 7 wherein said elongated tube extends the majority of the length of said conical wall section between said first and second outlets.

11. A hydrocyclone as recited in claim 1 wherein said elongated tube extends the majority of the length of said conical wall section between said first and second outlets.

12. A hydrocyclone as recited in claim 1 wherein said elongated tube is made of aluminum.

13. A hydrocyclone as recited in claim 1 wherein both said shell, including said conical wall section thereof, and said tube are made of plastic.

* * * * *